United States Patent [19]

Hagelberg et al.

[11] 4,341,173

[45] Jul. 27, 1982

[54] HYDROPULSE UNDERWATER PROPULSION SYSTEM

[75] Inventors: Allen C. Hagelberg, Diamond Bar; Clark E. Allardt, Claremont, both of Calif.

[73] Assignee: General Dynamics, Pomona Division, Pomona, Calif.

[21] Appl. No.: 126,781

[22] Filed: Mar. 3, 1980

[51] Int. Cl.[3] ..... F42B 19/30

[52] U.S. Cl. ..... 114/20 A; 60/221; 60/245; 114/337; 440/45

[58] Field of Search ..... 60/221, 222, 245, 250; 440/44, 45; 144/20 A, 337, 333

[56] References Cited

U.S. PATENT DOCUMENTS

| | | | |
|---|---|---|---|
| 1,117,351 | 11/1914 | Edlin | 60/221 |
| 1,315,352 | 9/1919 | Torazzi | 114/20 |
| 2,351,750 | 6/1944 | Fawkes | 60/221 X |
| 2,714,800 | 8/1955 | Gongwer | 60/221 |
| 2,903,850 | 9/1959 | Lang | 60/221 |
| 2,938,481 | 5/1960 | Maxwell et al. | 114/20 |
| 2,971,325 | 2/1961 | Gongwer | 60/221 X |
| 3,000,306 | 9/1961 | Wenzel et al. | 60/245 X |
| 3,060,682 | 10/1962 | Kemenczky | 60/221 |
| 3,079,753 | 3/1963 | Gongwer | 60/227 |
| 3,107,486 | 10/1963 | Linderfelt | 60/221 |
| 3,137,997 | 6/1964 | Kaminstein | 60/221 |
| 3,157,992 | 11/1964 | Kemenczky | 60/221 |
| 3,163,980 | 1/1965 | Turner | 60/221 |
| 3,335,685 | 8/1967 | Gimbel | 114/333 |
| 3,354,648 | 11/1967 | Asahina | 60/221 |
| 3,872,665 | 3/1975 | Jarry | 60/221 |
| 3,914,935 | 10/1975 | Burkes, Jr. | 60/250 X |
| 3,951,094 | 4/1976 | Jastram | 60/221 X |

*Primary Examiner*—Sherman D. Basinger

*Attorney, Agent, or Firm*—Henry M. Bissell; Edward B. Johnson

[57] ABSTRACT

A propulsion motor for an underwater vehicle such as an anti-submarine weapon. The motor includes a propulsion chamber into which water is admitted and then rapidly expelled through an exhaust nozzle, developing thrust to propel the vehicle. Gas generators are used to develop the successive hydropulses to expel the water following each filling of the motor chamber with water. In one particular embodiment of an anti-submarine weapon which is directed through the air to the vicinity of a submarine by a rocket motor, the hydropulse underwater propulsion system can use the same chamber as the rocket motor.

12 Claims, 7 Drawing Figures

HYDROPULSE UNDERWATER PROPULSION SYSTEM

BACKGROUND OF THE INVENTION

1. Field of the Invention

This invention relates to propulsion systems for underwater vehicles and, more particularly, to such systems designed to develop successive pulses of thrust by repeatedly filling a chamber and expelling the water therefrom at high velocity through one or more water jet nozzles.

2. Description of the Prior Art

Various attempts have been made in the past to develop thrust for propelling a vehicle by means of underwater thrust generators, some of which operate on principles akin to above-water rocket propulsion systems. Many of these are designed for hybrid systems, such as a boat or ship, in which the water jet propulsion device is of necessity located close to the surface of the water. Some depend upon extremely high through- or over-water speeds to develop a ram jet effect. These various prior art systems are exemplified in the Gongwer U.S. Pat. Nos. 2,714,800, 2,971,325 and 3,079,753; the Kemenczky U.S. Pat. Nos. 3,060,682 and 3,157,992; and in U.S. Pat. No. 3,107,486 of Linderfelt, No. 1,315,352 of Torazzi, No. 3,354,648 of Asahina, No. 2,938,481 of Maxwell et al, No. 2,351,750 of Fawkes, No. 3,163,980 of Turner, No. 3,137,997 of Kaminstein, No. 2,903,850 of Lang, No. 3,872,665 of Jarry, and No. 3,951,094 of Jastram et al.

In conjunction with the design of a new type of self-propelled anti-submarine weapon which is particularly directed to the destruction of submarines in relatively shallow water, an area which has heretofore presented problems which prevent the most effective utilization of currently known anti-submarine weapon systems, a particular type of underwater propulsion system is needed to propel the weapon at a reasonable average velocity while permitting a reduced velocity at periodic intervals to accommodate the needs of an effective sonar acquisition and tracking system. The present invention fills that need.

SUMMARY OF THE INVENTION

In brief, particular arrangements in accordance with the invention comprise a chamber, a nozzle communicating with the chamber and directed rearwardly of the vehicle in which the hydropulse motor is mounted to direct a water jet to develop thrust for the vehicle, water ports with opening and closing mechanisms for periodically admitting water to the chamber, and a plurality of gas generators communicating with the chamber for expelling the water out of the chamber through the nozzle. In one particular arrangement in accordance with the invention, the water port valves comprise spring loaded elements which operate automatically, opening by a biasing spring when a previous hydropulse is approaching termination and closing to seal off the water ports upon the firing of a gas generator to develop the next hydropulse. In another arrangement in accordance with the invention, the valves are solenoid actuated and operated in a controlled sequence relative to the firing of the gas generators to permit the associated vehicle to coast to a low enough speed to permit effective use of acoustic detection devices for tracking an underwater target, such as a submarine.

In one particular arrangement in accordance with the invention, the chamber of the hydropulse propulsion motor is the same chamber which is used by a previously fired rocket motor during over-water delivery of the weapon vehicle to the vicinity of the target. A limited number of gas generators are provided in order to limit the range of the propulsion system in accordance with the limit of the associated target acquisition capability.

DETAILED DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
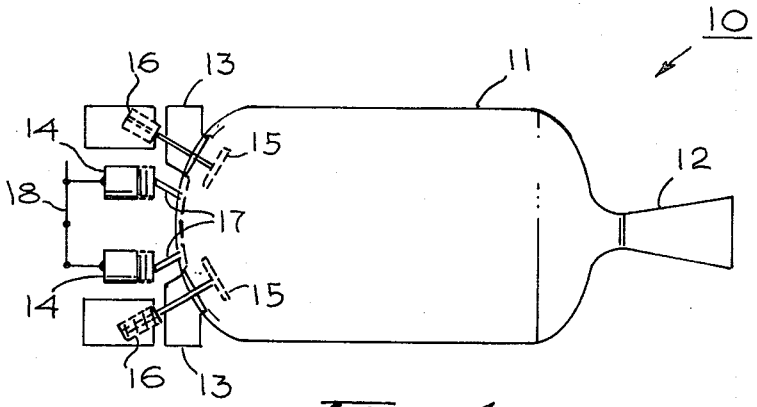
FIG. 1 is a schematic representation of one particular arrangement in accordance with the invention.
Figure 2:
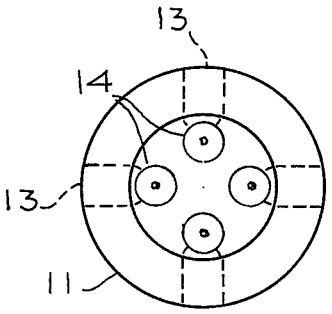
FIG. 2 is an end view of the arrangement of FIG. 1.

FIGS. 1 and 2 illustrate schematically one particular arrangement of a hydropulse motor 10 in accordance with the present invention. This is shown as comprising a chamber 11, nozzle 12, water ports 13 and gas generators 14. Each of the water ports 13 is equipped with a valve 15 for opening and closing the ports. The valves 15 are individually biased toward the open position by associated biasing springs 16. Each gas generator 14 is connected to the chamber 11 by way of a passage 17. Electrical leads 18 extend from the gas generators 14 to an associated control system (not shown in FIG. 1) to ignite the gas generators in succession at selected time intervals in accordance with the mode of operation of the hydropulse motor in an anti-submarine weapon.

In operation, following water entry of an anti-submarine weapon containing the hydropulse motor 10 (see FIG. 7) the chamber 11 fills with water through the inlet ports 13. Thereafter, the first of the gas generators 14 is fired, developing substantial pressure within the chamber 11 which causes the valves 15 to close the ports 13 and drives the water rearwardly from the chamber 11 through the exit nozzle 12 with substantial force, developing significant thrust to propel the associated vehicle. Following combustion of the particular gas generator which was ignited, the developed pressure within the chamber 11 reduces as the water is expelled through the exit nozzle 12. As it approaches equilibrium with water pressure in the ports 13, the springs 16 cause the valves 15 to open and forward motion of the weapon vehicle, which is now coasting, serves to fill the chamber 11 with water again. Thereafter, at a preselected point in time, as determined by the associated control system (signal processor 81 of FIGS. 3 and 4) in accordance with vehicle velocity and other factors which may be related to target speed, parameters of the sonar acquisition and tracking systems, etc., the next gas generator 14 is fired to repeat the cycle of closing the valve 15, expelling water through the nozzle 12 to develop thrust to again accelerate the vehicle, etc.

Figure 3:
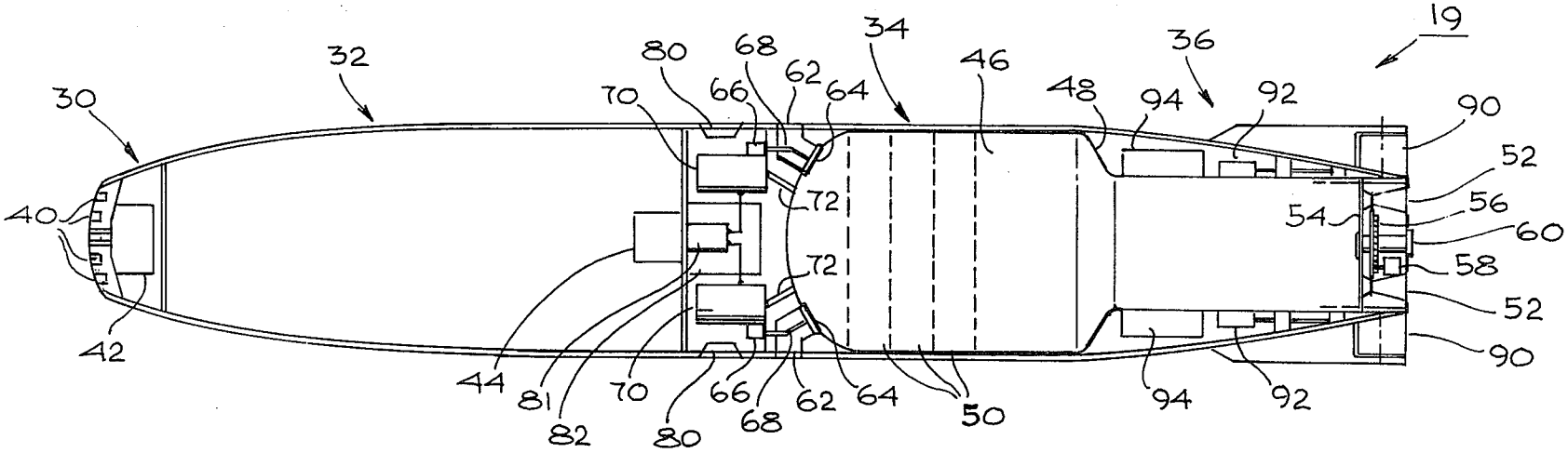
FIG. 3 is a plan sectional view of one particular type of anti-submarine weapon incorporating one particular embodiment of the invention.

FIG. 3 is a schematic view illustrating generally one particular type of anti-submarine weapon incorporating the invention. As particularly shown in FIG. 3, the weapon 19 is generally divided into four major sections: a forward transducer section and transceiver 30, a warhead 32, a propulsion system 34 and a directional control system 36.

The forward section 30 contains a mosaic array of acoustic transducers 40 mounted in the nose and a related transmitter and receiver making up an active, high power, monopulse tracking system. The transmitter, receiver and a contact fuze for the warhead are mounted in the block 42 behind the transducers.

The warhead 32 preferably contains from 150 to 250 pounds of explosive substantially filling the warhead chamber, together with a safe and arm protected detonator 44 shown to the rear of the warhead. A tube (not shown) is provided to carry the cabling from the detonator 44 to the nose for connection to the fuze.

The propulsion system 34 of the present invention in this particular embodiment is dual purpose. Its major component is the chamber 46 enclosed by a housing 48. For rocket propulsion, the chamber 46 contains one or more segmented-grain burn units 50 and a plurality of gas exhaust nozzles 52. The rocket propulsion system serves to drive the weapon 19 from shipboard launch to water entry in the vicinity of a target. The burn units 50 will have been completely consumed by the time the weapon 19 enters the water. At this point, the gas jet nozzles 52 are closed by means of a rotatable plate 54 having a plurality of holes matching the openings in the gas jet nozzles 52. The plate 54 is rotated until its holes are no longer in alignment with the gas nozzle openings by means of a spur gear arrangement 56 and electric motor 58. Thus the gas nozzles 52 are closed off, leaving as the only opening to the aft end of the chamber 46, a water jet nozzle 60.

For propulsion under water, the chamber 46 is permitted to fill with water and thereafter a gas generator is ignited to drive the water outward through the nozzle 60, thereby generating a hydropulse of thrust. Sea water enters the chamber 46 through inlet passages 62 and valves 64. The valves are controlled by solenoids 66 and associated linkages 68. A plurality of gas generators 70, communicating with the chamber 46 via tubes 72, are spaced circumferentially about the longitudinal axis of the weapon 19 and fired in succession to generate a series of hydropulses to propel the weapon through the water.

Also located in the region between the chamber 46 and the warhead 32 are a plurality of side mounted acoustic transducers 80, which are used to initially locate the submarine target, and a primary battery and signal processor 81 mounted in the central block 82.

The aft section 36 contains the steering system for the vehicle comprising the steering planes 90, actuators 92 and control electronics and related systems which are mounted within the blocks 94.

Figure 4:
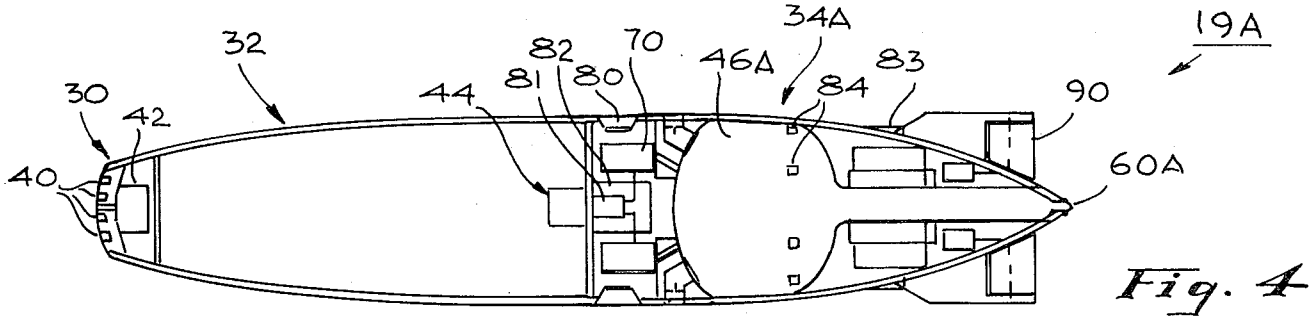
FIG. 4 is a another particular anti-submarine weapon incorporating an alternative embodiment of the invention.

An alternative embodiment of the present invention is depicted in FIG. 4. The weapon 19A of FIG. 4 is specifically designed to be air dropped from a helicopter or other ASW aircraft and therefore has dispensed with the rocket propulsion motor of the weapon of FIG. 3. This weapon 19A is essentially like the weapon 19 of FIG. 3, the principal difference being the absence of a rocket propulsion system in the chamber 46A. This chamber is provided with a single exit nozzle 60A for exiting the sea water jet which is driven out of the chamber 46A by means of the gas generators 70 in the same manner as the hydropulse portion of the propulsion system 34 of the vehicle 19 of FIG. 3. As indicated above, the gas generators 70 fire sequentially at intervals controlled by the microprocessor 81 in the central block 82 whenever the weapon speed drops to a predetermined level and the chamber 46A has filled with water, as detected by speed sensors 83 and floats 84.

Figure 5:
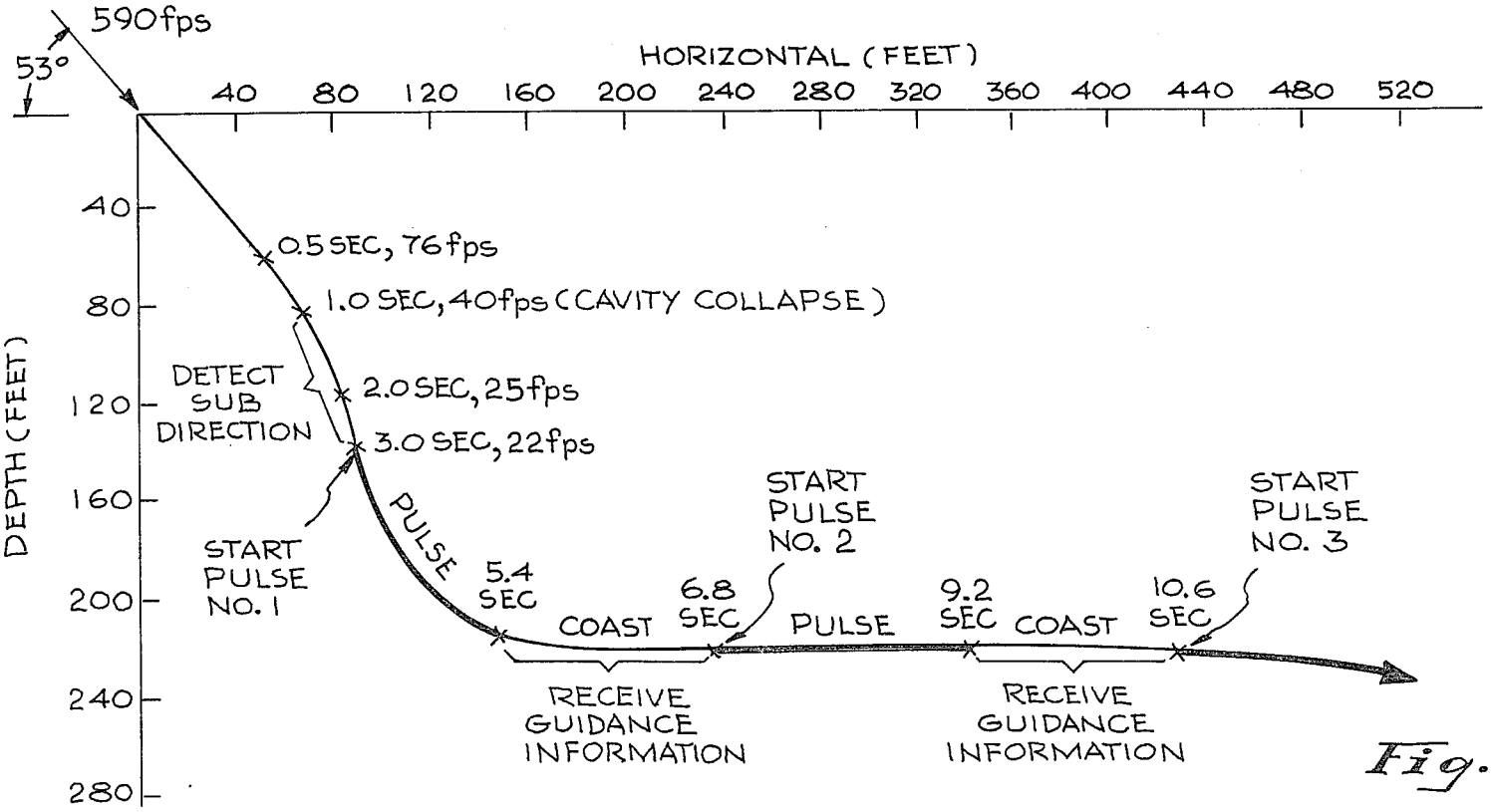
FIG. 5 is a graphical plot illustrating the mode of initial operation of an anti-submarine weapon utilizing the propulsion system of the invention.

FIG. 5 is a graphical plot illustrating typical initial operation of the hydropulse propulsion system of the weapon upon initial entry into the water. FIG. 5 illustrates the course of the weapon beginning at water entry with a typical entry angle of 53 degrees and velocity of 590 ft. per second (fps). Within one-half second following water entry, the velocity has dropped to 76 fps., and at one second after entry the velocity has dropped to 40 fps., at which time the bubble cavity about the weapon collapses so that water contact is established with the acoustic transducers. During the next two seconds, the direction of the submarine target is detected by means of the side mounted transducers 80 and the hydropulse chamber is filled with water. Thereafter, the first gas generator 70 is fired to generate the first hydropulse. This accelerates the weapon and enables it to turn in the direction of the target. Following the first hydropulse, the vehicle coasts and receives guidance information while its propulsion chamber is again filled with sea water. Thereafter, a second gas generator is ignited to develop a second hydropulse which again accelerates the vehicle and propels it toward the submarine. The sequence is repeated until the submarine is destroyed or the gas generators are exhausted, the vehicle alternately coasting while it receives guidance information and propelling itself toward the target.

Figure 6:
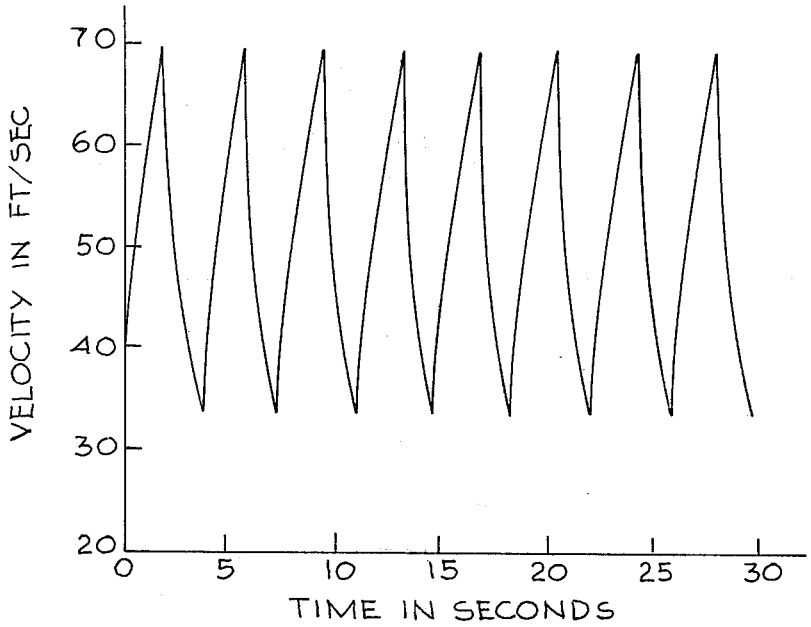
FIG. 6 is another graphical plot llustrating the velocity profile of an anti-submarine weapon employing the invention.

FIG. 6 is a graphical plot of the velocity profile of the weapon. From this plot, it may be seen that velocity varies between approximately 35 and 70 fps. during successive hydropulses, with an average velocity of approximately 51 fps. or 30 knots. This is adequate to deal with most submarine targets, particularly in the shallow water conditions for which the weapon is specifically designed. Where the submarine is running, the delivery system can drop the weapon into the water ahead of the submarine, thus developing the necessary lead for intercept and kill.

Further particulars of the overall weapon system utilizing the hydropulse motor of the present invention, particularly with respect to the acquisition, tracking and guidance aspects, may be found in our co-pending application Ser. No. 126,782, filed Mar. 3, 1980 and assigned to the assignee of this application.

By virtue of its mode of operation, the hydropulse propulsion system of the present invention uniquely adapts the associated anti-submarine weapon to deal with the problems of underwater target detection encountered during propulsion to the target. The function of the guidance system is to locate the target and to generate steering commands. The guidance system must overcome problems of self-noise, surface and bottom reverberation, and target acquisition. Underwater weapons like acoustic homing torpedoes using acoustic guidance are usually performance-limited by self-noise. If they move slowly, the acoustic sonar can measure the target location, the velocity and other necessary parameters with a high signal-to-noise ratio and, therefore, with improved accuracy. However, the higher speed moving target will have a better chance to escape. The higher the weapon velocity, the higher the self-noise until at about 35 knots the guidance becomes noise limited and the system performance becomes marginal. This limiting noise is due to weapon propulsion and flow noise.

However, the weapon utilizing the present invention provides a unique solution to this problem. The hydropulse motor provides a varying velocity profile for the weapon with a velocity below 35 knots for a substantial proportion of the time. During this time, the acoustic system is activated and operates in a self-noise-free environment with the necessary error measurements. This technique of observing the target only when the self-noise is low solves the self-noise problem.

To allow suitable filling times and rational chamber pressures, the motor timing cycle, on our base line design, is on the order of 3.5 seconds per pulse. Using the low velocity "quiet time" for acoustic target measurement restricts the error update time for every motor pulse to approximately 0.3 to 1 "look" per second. While this relatively low data rate for the guidance system may develop a lag in the target homing, particularly when the target is approached from the side, this lag improves the kill probability by biasing the weapon contact to the more vulnerable area behind the center of the submarine. Another factor associated with the varying weapon velocity is the non-linear relationship between steering forces and angular turning rate. This dynamic variable is processed by a microcomputer included in the guidance sub-system.

More particularly, FIG. 6 illustrates the velocity profile for a 260 lb. gross weight weapon of the configuration shown in FIG. 4. The underwater range is 1520 feet for an eight-pulse motor with a thrust profile of 1.7 seconds on and 1.8 seconds off. The thrust per pulse is 350 lbs. Average velocity for the 1520 feet is 51.3 fps. (30.8 knots). Such a weapon is configured to utilize torpedo suspension bands, such as the MK 78 MOD 0 band, to attach the weapon to standard bomb racks on an ASW aircraft or helicopter. With the simplicity and reliability of this weapon, there is no need for an electrical interface between aircraft and weapon. The weapon is initialized at the time of drop by a conventional arming wire. For ultimate safety, the weapon electronics are not activated until the primary battery (in block 82 of FIG. 4) is initialized by pulling the arming wire. This causes activation of the contact fuze circuitry. However, the warhead safe and alarm mechanism associated with the detonator 44 (FIG. 4) cannot arm the warhead until impact with the water. Also, warhead arming starts a 40 second timer (not shown) which will serve to detonate the warhead if the weapon has not impacted the target or the sea bottom in that time interval. During that time, the propulsion system will have expended all of the hot gas generator units 70.

Figure 7:
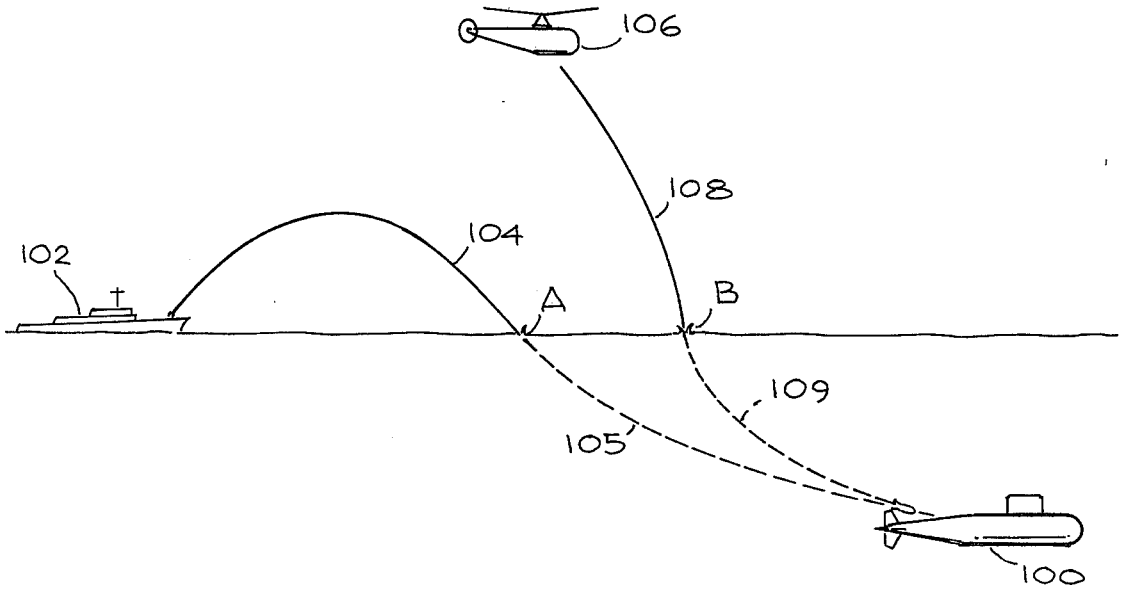
FIG. 7 is a schematic diagram illustrating generally the use to which the invention is directed in anti-submarine weapons.

FIG. 7 illustrates generally the way in which a weapon utilizing a hydropulse propulsion system in accordance with the present invention may be delivered to the vicinity of a submarine and then directed to contact for destruction. Where weapons are to be launched from shipboard, a weapon 19 corresponding to the arrangement shown in FIG. 3 will be employed. Upon detection of the submarine 100 by sonar or other means on the ship 102, the rocket motor of the chamber 34 is fired and the weapon is propelled as a missile on a ballistic course 104 to a point A in the vicinity of the submarine 100 where it enters the water.

In the alternative, where the weapon is to be dropped from a helicopter 106 or other ASW aircraft, a weapon corresponding to FIG. 4 will be employed. Such a weapon is transported by the helicopter 106 to the vicinity of the submarine 100, detected by sonobuoys, dipping sonar, or magnetic anomaly detection, and dropped to enter the water at point B.

In either event, upon entry of the weapon into the water, the propulsion system of the present invention becomes activated and operates as described to drive the weapon along a course 105 or 109 to impact and destroy the submarine 100.

Because of the conceptual and practical simplicity of the hydropulse propulsion system of the weapon and its integration with other sub-systems into the overall unit, extremely high reliability of the weapon is achieved with very low cost.

Although there have been described above specific arrangements of a hydropulse propulsion system for use in an anti-submarine weapon in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A hydropulse propulsion system for a weapon designed to operate under water against surface or undersea targets comprising:

a housing for the weapon;

a chamber within the housing near the aft end thereof;

a water jet nozzle projecting aft from the chamber; and means for periodically admitting sea water to the chamber and thereafter expelling the sea water through the nozzle with substantial force to develop thrust for propelling the weapon, the expelling means including:

a plurality of discrete gas generators mounted forward of the chamber, a corresponding plurality of tubes individually associated with the gas generators, each connecting an associated gas generator with the chamber to transmit combusted gas to the chamber at substantial pressure, electrical ignition means coupled to the gas generators for igniting the gas generators individually, and control means for selectively activating the ignition means to ignite the gas generators individually at successive time intervals selected to develop a speed for the weapon during at least a portion of a coasting interval between ignitions which is below the speed at which onboard acoustic detectors are disabled by flow noise.

2. The system of claim 1 wherein the sea water admitting means comprises an inlet passage to the chamber and valve means for controlling the opening of the inlet passage.

3. The system of claim 2 further comprising means coupled to the valve means for controlling it to alternatively open and close the inlet passage.

4. The system of claim 3 wherein the valve means comprises at least one valve controlling the inlet passage, and wherein the coupled means comprises a solenoid actuator coupled to the valve.

5. The weapon of claim 3 wherein the valve means comprises at least one valve and spring biasing means for urging the valve toward a position opening the inlet passage while permitting the valve to close when pressure is developed within the chamber to expel water therefrom.

6. The system of claim 1 wherein the chamber initially comprises a rocket motor for providing propulsive thrust prior to water entry of the weapon to propel the weapon from ship-board launch through the air to a selected point of water entry in the vicinity of a target, the rocket motor further comprising a plurality of rocket jet nozzles extending rearwardly from the chamber.

7. The system of claim 6 further including means for closing off the rocket jet nozzles following burn-out of the rocket motor fuel.

8. The system of claim 1 wherein the time intervals between ignitions are selected to be approximately 3.5 seconds.

9. The system of claim 8 wherein each gas generator is operated to develop a pulse expelling sea water through the nozzle for approximately 1.7 seconds followed by a coasting interval of approximately 1.8 seconds to develop a velocity for the weapon which is below 35 knots for a substantial proportion of each pulse cycle.

10. The method of using the expended rocket chamber of an undersea weapon which is rocket propelled through the air to a point of water entry as a chamber for propelling the weapon under water comprising the steps of:

detecting the entry of the weapon into the water;

closing the rocket nozzle ports while leaving open a water jet nozzle;

permitting sea water to enter the spent rocker chamber;

thereafter directing gas at substantial pressure into the chamber from a selected one of a plurality of gas generators, each being mounted forward of the chamber and communicating therewith through a small tube, to eject a pulse of sea water through the water jet nozzle;

thereafter permitting the weapon to coast for a predetermined interval sufficient for its speed to reduce below a speed at which onboard acoustic detectors are disabled by flow noise; and repeating the cycle of permitting the chamber to fill with sea water and directing gas at substantial pressure into the chamber from succeeding individual gas generators until all gas generators have been spent.

11. The method of claim 10 wherein, during each pulse cycle, gas is directed to the chamber from a gas generator for approximately 1.7 seconds and wherein the period of coasting is for about 1.8 seconds.

12. The method of claim 10 wherein the weapon is permitted to coast at a speed below 35 knots for a substantial portion of the time.

* * * * *